United States Patent [19]

Buhl

[11] Patent Number: 4,633,236

[45] Date of Patent: Dec. 30, 1986

[54] MAILBOX

[75] Inventor: Holger Buhl, Birkerød, Denmark

[73] Assignee: Buhl Automatic, V/Holger Buhl, Birkerød, Denmark

[21] Appl. No.: 747,306

[22] Filed: Jun. 21, 1985

[51] Int. Cl.[4] ..... G08B 13/16

[52] U.S. Cl. ..... 340/569; 232/37

[58] Field of Search ..... 232/17, 37; 340/553, 340/554, 555, 569; 116/5, 6

[56] References Cited

U.S. PATENT DOCUMENTS

| | | | |
|---|---|---|---|
| 2,038,878 | 4/1936 | Strutt | 340/553 |
| 2,197,028 | 4/1940 | Wolff | 340/553 X |
| 2,968,804 | 1/1961 | Buffington | 340/569 |
| 3,309,689 | 3/1967 | Keeney | 340/555 |
| 3,634,884 | 1/1972 | Ross | 340/553 |
| 3,909,819 | 9/1975 | Radford | 340/569 X |

*Primary Examiner*—Robert P. Swiatek

*Attorney, Agent, or Firm*—Oblon, Fisher, Spivak, McClelland, & Maier

[57] ABSTRACT

A mailbox including an indicator indicating the presence of mail, if any, and including a detector having a transmitting and receiving ultrasonic transducer. The transducer transmits ultrasonic waves into the mailbox and based on the received ultrasonic waves indicates alterations in the reflected energy. In this manner mail in the mailbox is detected even if the mail does not take up much room. The detector detects alterations in the frequency as a consequence of movements in the mailbox or detects alterations in the pattern of reflection as mail in the mailbox is disturbing the propagation paths of ultrasound in the mailbox.

7 Claims, 4 Drawing Figures

MAILBOX

FIELD OF THE INVENTION

The invention relates to a mailbox comprising an indicator indicating the presence of mail, if any, and including a detector.

BACKGROUND ART

Mailboxes are known comprising indicators in the form of lever arms which are activated by means of mechanical systems when mail is present in the mailbox. Such mechanical systems are, however, not quite satisfactory as they usually depend on the mail being of a predetermined volume and/or a predetermined weight.

Electromechanical signaling means may indicate the presence of mail in a mailbox. These electromechanical signaling means are, however, encumbered with the same drawbacks as above.

SUMMARY OF THE INVENTION

The object of the invention is to illustrate how these draw-backs can be eliminated, and according to the invention the detector is adapted to transmit energy into the mailbox and to indicate possible alterations in the reflected energy. In this manner the detector can detect mail, if any, even when said mail does not take up much room.

The energy transmitted is preferably ultrasonic energy, the detector either detecting possible alterations in the frequency as a consequence of movements in the mailbox or detecting possible alterations in the pattern of reflection as mail optionally present in the mailbox is reflected on one or more diffusion paths of the diffusion of ultrasound in the mailbox.

The energy transmitted may, however, also be composed of infra-red light.

BRIEF DESCRIPTION OF DRAWING

The invention will be described below with reference to the accompanying drawing, in which.

DESCRIPTION OF PREFERRED EMBODIMENTS

Figure 1:
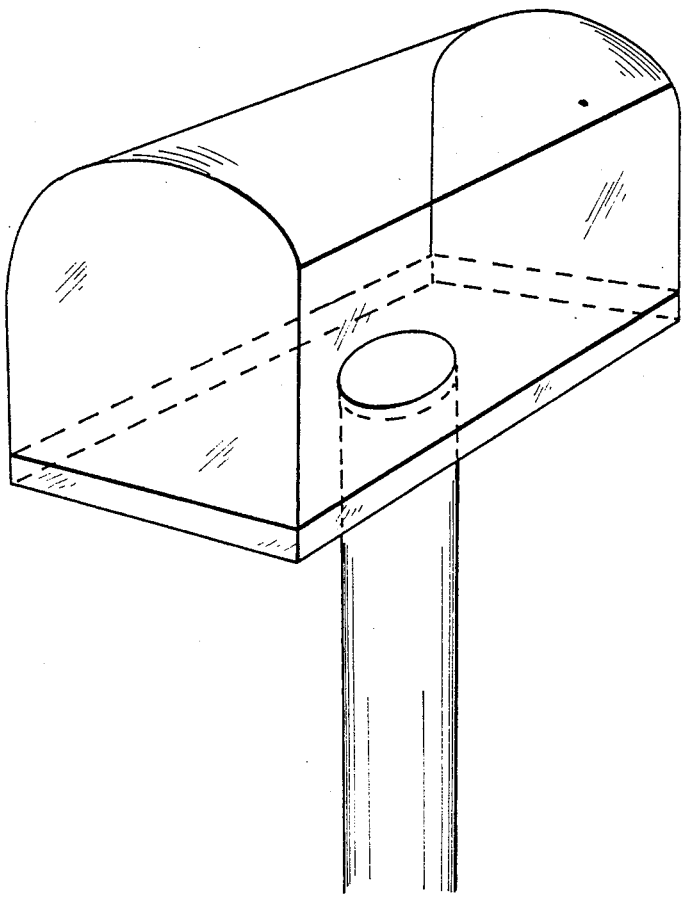
FIG. 1 illustrates a mailbox according to the invention.
Figure 2:
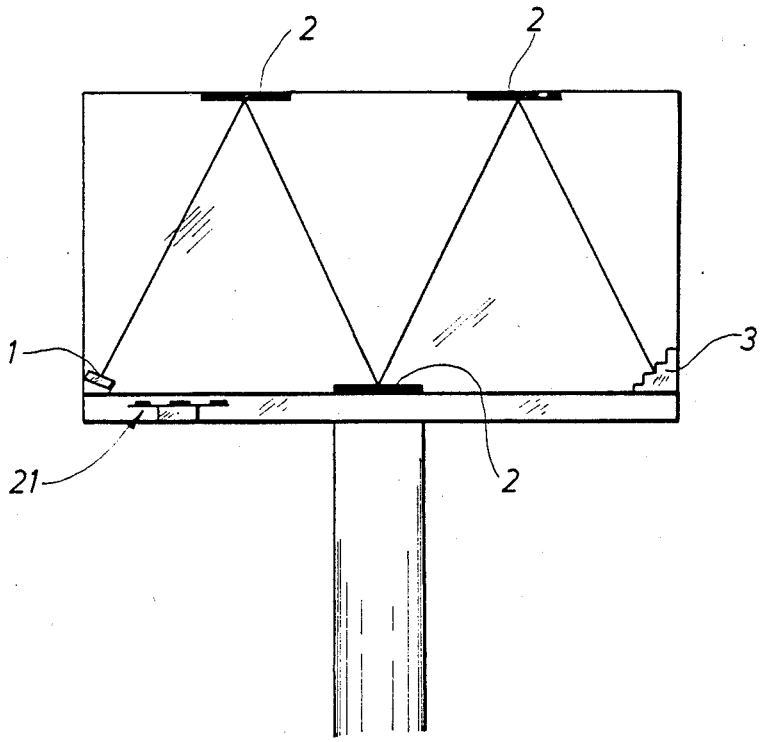
FIG. 2 is a sectional view of the mailbox of FIG. 1, and FIGS. 3*a* and 3*b* illustrate the associated electronic circuit.

It is not unusual that the mailboxes in USA are positioned up to 700 m from the houses, and it is therefore an advantage when the mailbox can be tested from the house. According to the invention the mailbox is provided with a detector transmitting energy into the mailbox and indicating possible alterations in the energy reflected. The energy may for instance be composed of ultrasonic waves, cf. FIG. 2. An ultrasonic crystal 1 transmits ultrasonic waves at a frequency of about 40–80 kHz. The ultrasonic waves propagate in straight lines. Reflectors 2, cf. FIG. 2, allow a propagation of the ultrasonic waves along a zigzag path terminated by a reflector 3, preferably a prismatic reflector. The latter reflector implies that the reflected ray obtains the same direction as the incident ray. Consequently the reflected ray propagates along the same zigzag path as the transmitted ray and reaches the crystal 1. If the path of rays is interrupted no signal is returned to the crystal 1. As a result, there is obtained an indication of whether there is mail in the mailbox or not. Only one crystal is required for transmitting and receiving. The reflecting surfaces need only be interspaced less than the smallest possible length of the letters.

When the ray shall follow a zigzag path, the interior of the mailbox shall only be coated alternately with reflecting and absorbing material. The mailbox is either driven by means of batteries or by means of solar cells and is only transmitting pulses with a very low frequency so as to reduce the current consumption. A wireless transmission of signals to the housing requires, however, a certain minimum effect. The transmission of signals may for instance be performed at a frequency of 27 mHz.

Figure 3A:
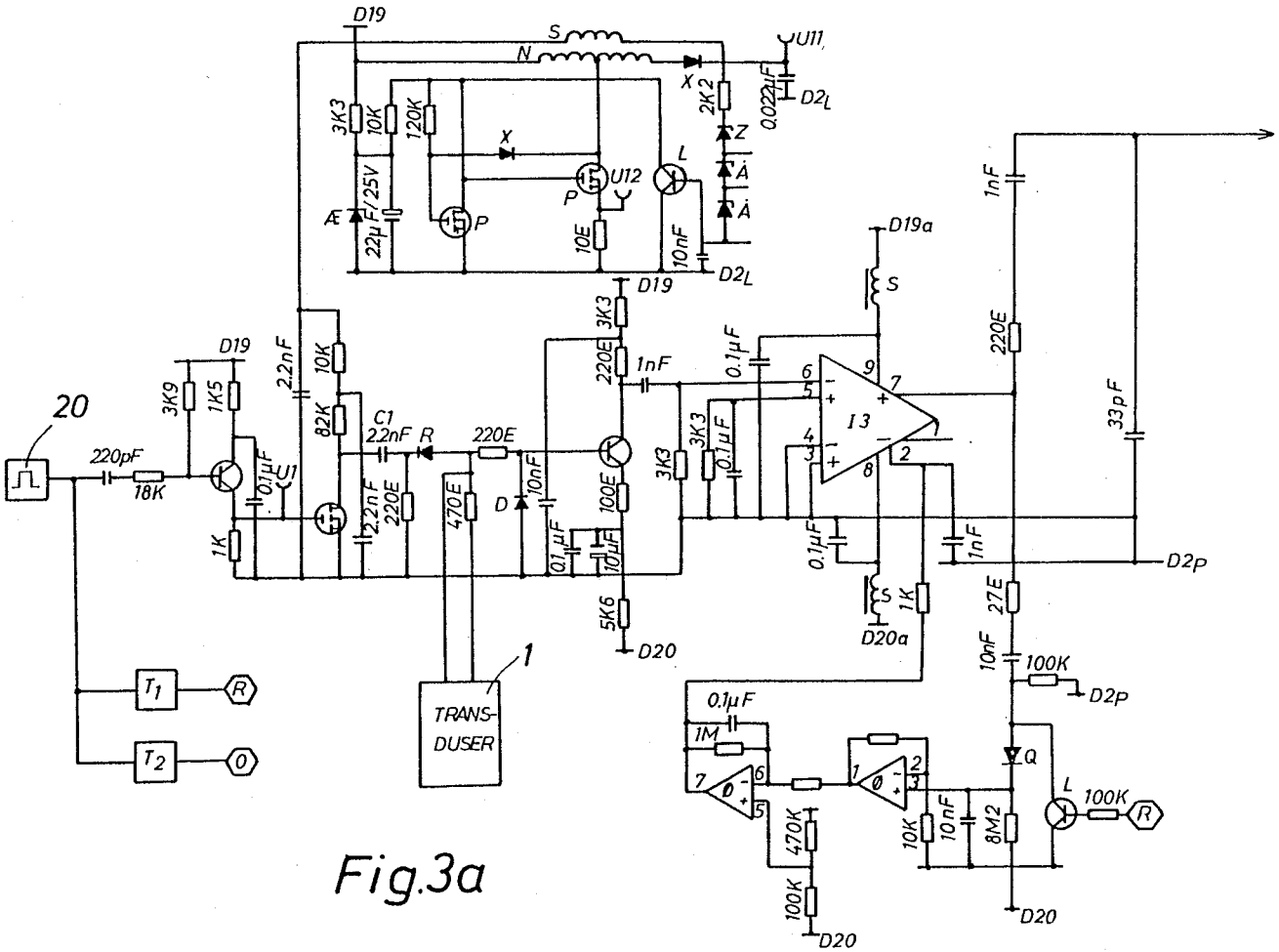
Figure 3B:
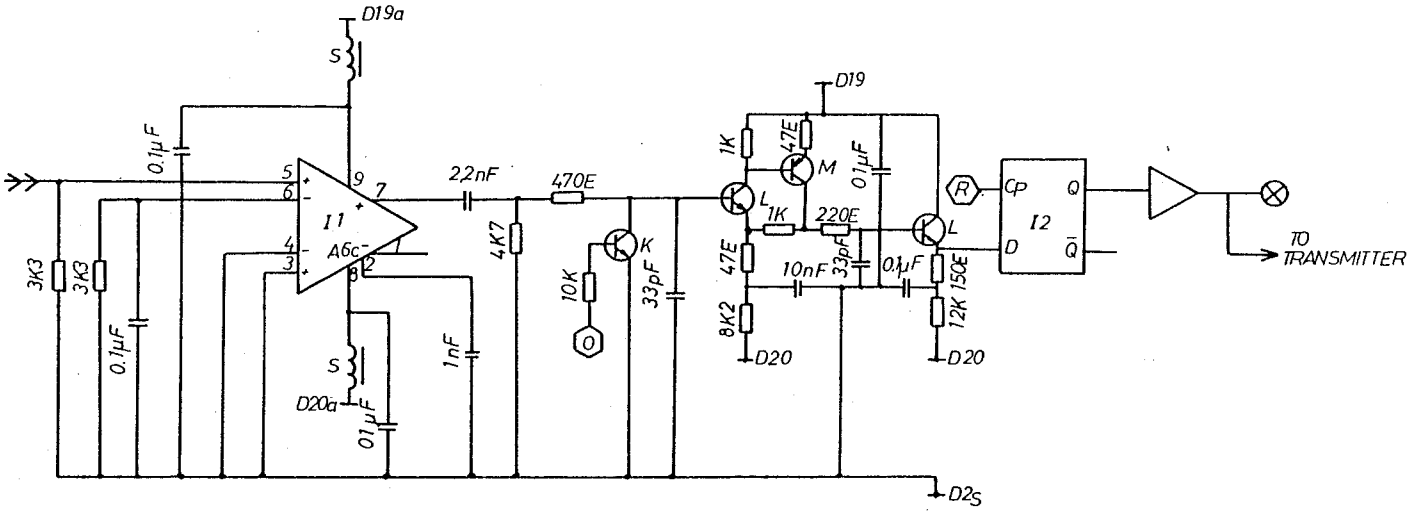

The associated electronic circuit is illustrated in FIGS. 3*a* and 3*b*. This circuit comprises a DC-DC-converter providing a DC-voltage of about 400 V, said voltage being used for charging a capacitor $C_1$ of 2.2 nF. The discharging of the capacitor $C_1$ is controlled by means of a square wave signal (at 20) of a frequency of 1 Hz. The discharge voltage is transmitted to the ultrasonic transducer 1 via rectifiers R. The high frequencies in the discharge signal excite the ultrasonic crystal 1 to oscillation at the reasonance frequency. As a result, the ultrasonic crystal transmits ultrasonic waves at a frequency in the range 40–80 kHz. The oscillations are, however, extinguished before the next discharge signal is supplied. The ultrasonic waves transmitted by the ultrasonic crystal may optionally be reflected and received by means of the same ultrasonic crystal 1. A separate ultrasonic receiver may, however, also be provided. The signal received is converted into an electric signal and is transmitted to an amplifier $I_3$ via a clipping and limiting circuit D, L. The clipping and limiting circuit ensures that the amplifier $I_3$ is not overloaded. An automatic amplification control (AGC) with associated circuits is provided in connection with the amplifier $I_3$. The amplified signal is transmitted to a detector N,M. A circuit blocking for a minimum time is provided in front of the detector, and a circuit blocking for a maximum time is provided behind the detector so as to provide a window in the time domain. The circuit may be situated in the bottom (at 21) of the mailbox, cf. FIG. 2.

The path of propagation is not necessarily zigzag-shaped as other paths of propagation may apply. The detector need only indicate possible alterations in the pattern of transmission and reflection.

The mailbox may also be constructed in such a manner that the presence of mail is signaled to the mailman.

According to an alternative embodiment, the Doppler-principle is used at for instance 80–100 kHz utilizing the fact that an alteration of the frequency occurs at a movement within the mailbox. The alteration of the frequency may be detected by means of a detector transmitting a signal and activating an indicator in the house in such a manner that it is possible to determine that a movement has taken place. In this case the detector of FIG. 2 need only be replaced by a conventional FM-detector.

Instead of an ultrasonic transducer, a pulse-driven infra-red semiconductor diode may be used in connection with a tube containing a lense system. Such a semiconductor diode emits an infra-red light ray propagating along a zigzag path, cf. FIG. 2. Then the same circuit as illustrated in FIGS. 3*a* and 3*b* can in principle be used.

I claim:

1. A mailbox comprising an indicator indicating the presence of mail, if any, said indicator including a transmitting and receiving transducer adapted to transmit ultrasonic waves within the mailbox and to receive reflections of ultrasonic waves from the mailbox in order to detect possible alterations in the reflected ultrasonic waves, said ultrasonic waves following one or more predetermined paths in the mailbox unless the ultrasonic waves are scattered or absorbed by means of mail in the mailbox, wherein one and the same ultrasonic transducer is used both for transmitting and receiving of said ultrasonic waves.

2. A mailbox as claimed in claim 1, characterized by the detector being adapted to detect alterations in the frequency as a consequence of movements in the mailbox.

3. A mailbox as claimed in claim 1, characterized by the ultrasonic waves having a frequency of about 80–100 kHz.

4. A mailbox as claimed in claim 1, characterized by means for recognizing the pattern of the reflected energy and indicating possible alterations in said pattern.

5. A mailbox as claimed in claim 1, characterized by the box on the inside being coated with a reflecting and an absorbing material, respectively.

6. A mailbox as claimed in claim 1, characterized by the path of the ultrasonic waves being terminated by a prismatic reflector.

7. A mailbox as claimed in claim 1, characterized by the ultrasonic waves having a frequency of about 40–100 kHz.

* * * * *